US006868615B2

(12) United States Patent
Malley

(10) Patent No.: US 6,868,615 B2
(45) Date of Patent: Mar. 22, 2005

(54) TELESCOPIC WEAPON AIMING SYSTEM

(76) Inventor: Paul Joseph Malley, 16 Strawberry Road, Kelso, Queensland 4815 (AU)

( * ) Notice: Subject to any disclaimer, the term of this patent is extended or adjusted under 35 U.S.C. 154(b) by 0 days.

(21) Appl. No.: 10/429,354

(22) Filed: May 5, 2003

(65) Prior Publication Data

US 2004/0025397 A1 Feb. 12, 2004

Related U.S. Application Data

(63) Continuation-in-part of application No. 09/433,317, filed on Nov. 3, 1999, now Pat. No. 6,574,900, which is a continuation-in-part of application No. 09/093,083, filed on Jun. 8, 1998, now Pat. No. 6,370,251.

(51) Int. Cl.[7] ..... F41G 1/42

(52) U.S. Cl. ..... 33/297; 33/298; 42/122; 42/129; 42/130

(58) Field of Search ..... 42/122, 129, 130, 42/133; 33/297, 298; 350/10, 54, 550; 356/4.03, 21, 251; 359/823

(56) References Cited

U.S. PATENT DOCUMENTS

| | | | | | |
|---|---|---|---|---|---|
| 2,094,623 | A | * | 10/1937 | Stokey | 356/247 |
| 2,807,981 | A | * | 10/1957 | Barnes | 359/427 |
| 2,891,445 | A | * | 6/1959 | Heinrich | 356/247 |
| 2,949,816 | A | * | 8/1960 | Weaver | 356/247 |
| 3,392,450 | A | * | 7/1968 | Herter et al. | 42/122 |
| 3,744,133 | A | * | 7/1973 | Fukushima et al. | 42/121 |
| 3,777,404 | A | * | 12/1973 | Oreck | 42/120 |
| 3,948,587 | A | * | 4/1976 | Rubbert | 356/21 |
| 4,102,053 | A | * | 7/1978 | Colwell | 42/136 |
| 4,202,601 | A | * | 5/1980 | Burbo et al. | 359/409 |
| 4,263,719 | A | * | 4/1981 | Murdoch | 33/297 |
| 4,403,421 | A | * | 9/1983 | Shepherd | 42/122 |
| 4,483,598 | A | * | 11/1984 | Leightner et al. | 359/420 |
| 4,584,776 | A | * | 4/1986 | Shepherd | 42/122 |
| 4,616,421 | A | * | 10/1986 | Forsen | 42/130 |
| 4,632,547 | A | * | 12/1986 | Kaplan et al. | 356/247 |
| 5,339,720 | A | * | 8/1994 | Pellarin et al. | 89/41.19 |
| 5,365,670 | A | * | 11/1994 | Klimochko | 42/119 |
| 5,442,860 | A | * | 8/1995 | Palmer | 42/120 |
| 5,491,546 | A | * | 2/1996 | Wascher et al. | 356/4.03 |
| 5,561,563 | A | * | 10/1996 | Chesnut et al. | 359/823 |
| 5,713,127 | A | * | 2/1998 | Chobot et al. | 29/852 |
| 5,771,595 | A | * | 6/1998 | Bell | 42/122 |
| D403,686 | S | * | 1/1999 | Reese | D16/130 |
| 5,924,234 | A | * | 7/1999 | Bindon et al. | 42/123 |
| 5,973,315 | A | * | 10/1999 | Saldana et al. | 250/214 VT |
| 6,032,374 | A | * | 3/2000 | Sammut | 42/122 |
| 6,094,304 | A | * | 7/2000 | Wallace et al. | 359/425 |
| 6,111,692 | A | * | 8/2000 | Sauter | 359/429 |

FOREIGN PATENT DOCUMENTS

EP 1136784 * 9/2001

* cited by examiner

*Primary Examiner*—Michael J. Carone
*Assistant Examiner*—John Richardson
(74) *Attorney, Agent, or Firm*—Armstrong Teasdale LLP

(57) ABSTRACT

A telescopic optical sight for aiming a weapon at a target is described. The telescopic optical sight comprises an eyepiece, a first reticule, a second reticule spaced laterally from said first reticule, and at least one object lens. The first and second reticules are between the eyepiece and the object lens, and the second reticule aligns with the first to aim the weapon. The first reticule is the principle focus for the telescopic optical sight.

11 Claims, 2 Drawing Sheets

TELESCOPIC WEAPON AIMING SYSTEM

CROSS REFERENCE TO RELATED APPLICATIONS

This application is a Continuation-in-Part of application Ser. No. 09/433,317 filed Nov. 3, 1999 now U.S. Pat. No. 6,574,900, which is a Continuation-in-Part of application Ser. No. 09/093,083 filed Jun. 8, 1998, now U.S. Pat. No. 6,370,251.

FIELD OF THE INVENTION

The present invention is directed to a device for enhancing the accuracy of a conventional single reticule telescopic sight.

BACKGROUND OF THE INVENTION

This invention relates generally to telescopic sighting and, more specifically to an improved telescopic sight for the aiming of weapons.

Normal optical (telescopic) sights have a single point of reference called a reticule (crosshairs) which the shooter has to align with the target. The problem with this single point of reference is that the shooters eye has to be aligned along the centerline of the weapon while positioning the crosshairs on the target, therefore, the telescopic sight offers no help, and in fact introduces a source of error. In other words, shooters have to learn to keep their heads in the same position each time they aim, which of course is why it is so difficult to hit the target.

BRIEF SUMMARY OF THE INVENTION

In one aspect, a telescopic optical sight for aiming a weapon at a target is provided. The telescopic optical sight comprises an eyepiece, a first reticule, a second reticule spaced laterally from said first reticule, and at least one object lens. The first reticule and the second reticule are between the eyepiece and the object lens. The first reticule is the principle focus for the sight and the second reticule aligns with the first to aim the weapon.

In another aspect, a weapon sighting device for use within a telescopic optical sight is provided. The device comprises a surface having a discontinuity at the center of the surface. The sighting device is configured to be incorporated into a telescopic optical sight at a position between a reticule and an object lens and wherein the discontinuity is spaced longitudinally from and aligned with a reticule.

In still another aspect, a method for aligning a telescopic sight with a target is provided. The telescopic sight includes an eyepiece, an object lens, a first reticule and a second reticule, the first reticule and the second reticule being between the eyepiece and the object lens,. The method comprises aligning a first reticule of the sight with the target and superimposing the second reticule over the first reticule, while the first reticule is in alignment with the target.

DETAILED DESCRIPTION OF THE INVENTION

Figure 1:
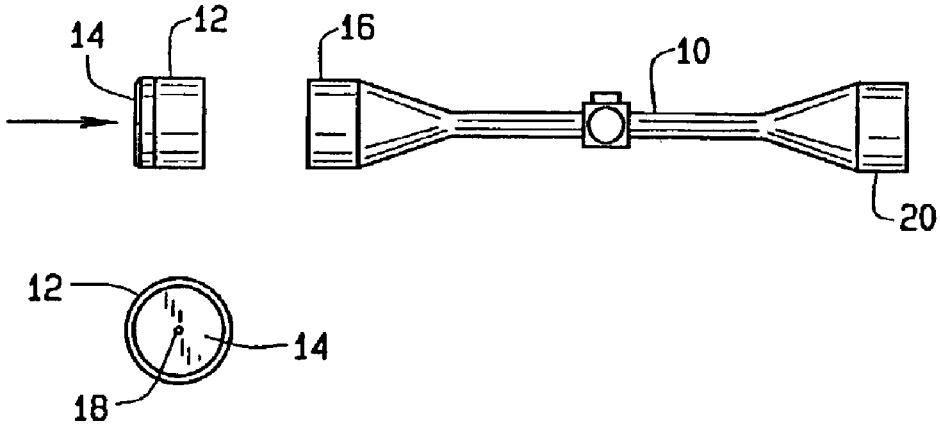
FIG. 1 is a view of the invention as an attachment to a normal telescopic sight.

This invention is essentially a surface with a discontinuity at its center placed some distance from but aligned with a reticule of a telescopic sight. Referring to FIG. 1 an optical sight item 10 (e.g. a single reticule telescopic sight) is shown. Also shown is a flexible sleeve 12 into which is inserted a disk 14. Sleeve and disk 14 in combination form an assembly which may be pushed over an eyepiece 16 of sight 10 to form a complete unit. The disk and sleeve assembly, referred to herein as a weapon aiming device, or weapon sighting device, provides a second point of reference, or second reticule, for a sight or aiming device that has only one point of reference or reticule. The single point of reference is sometimes referred to in the art as a principle focus point, and is ordinarily provided as a single reticule within the telescopic sight. In one embodiment, the second reticule is a disk 14 fabricated from a suitably colored transparent material with a hole 18 at a center of disk 14.

In exemplary embodiments, disk 14 is placed between an observers eye (line of sight indicated by the arrow) and a reticule of sight 10, though by suitably arranging the optics of the sight any arrangement is possible, for example placing the weapon aiming device over a second end 20 of sight 10.

The weapon aiming device may include a circular tinted disk 14 with a hole at its center placed at one of a flexible sleeve 12. Sleeve 12 enables easy attachment to an optical or similar functioning sight 10. The tint may be of any color, however it has to be of sufficient intensity and contrast to the coloring of the attached sight system (e.g. sight 10) to enable the hole at its center to be visible and superimposed on the reticule of sight 10.

Diameter of hole 18 at the disk center should be optimized for the geometric shape of the symbol of the reticule (e.g. cross hairs). Alternatively, hole 18 could simply be an area of contact with the remaining area of disk 14, as long as there are sufficient conditions and difference in color between disk 14 and lenses incorporated within sight 10. In one exemplary embodiment, a diameter of approximately 1 mm is an expected order of magnitude for this hole or contrasting area.

The aiming device may include multiple disks 14, mounted in sleeve 12, one behind the other, each one being easily removable such that the overall transparency may be altered to better suit ambient light conditions. The multiple disks may incorporate different hole sizes such that removal of one or more may alter a size of the hole presented to a user of the aiming device. The aiming device may also include a number of optically polarized disks arranged such that their relative movement will effect their transparency. The aiming device may also include a disk made from a number of sections such that their relative movement will alter the size of the center hole.

The aiming device may also include an electrically active screen (e.g., liquid crystal display) such that its color and center hole can be varied. The hole 18 at the center would not necessarily be a physical hole in the screen, but simply an area of different aspect.

Figure 2:
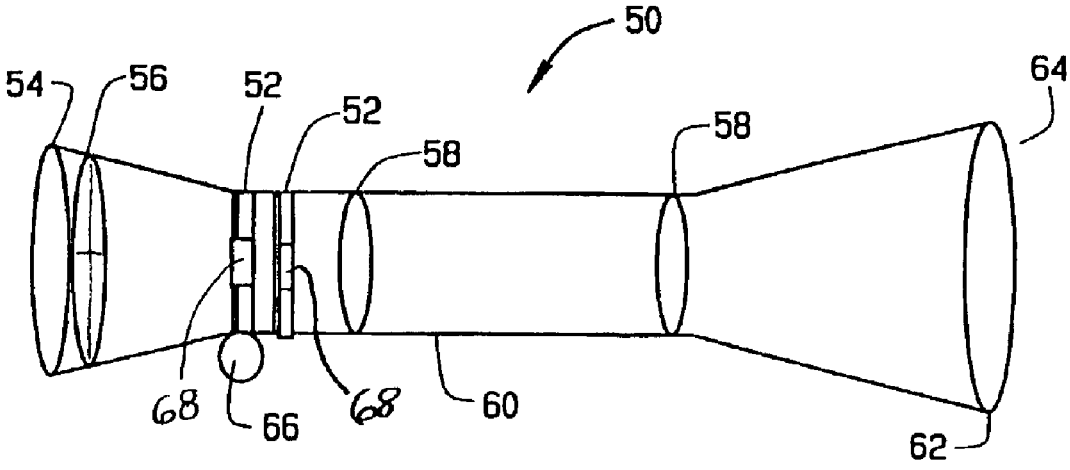
FIG. 2 is a diagrammatic representation of the invention used internally as a second reticule in a telescopic sight.

The aiming device may form an integral part of an optical or similar functioning sight, rather than as a removable attachment as shown in FIG. 1. FIG. 2 illustrates a telescopic sight 50 which incorporates a second reticule, for example, internal disks 52 to improve accuracy of sight 50. Disks 52 incorporate the same features as disks 14 (shown in FIG. 1). Telescopic sight 50 further includes an eyepiece lens 54. A second reticule (e.g. disks 52) is fit into sight 50 between a first reticule 56 and object lenses 58 which are located within collimator 60. Sight further includes a lens 62 at a forward facing end 64 of sight 50. Adjustment means 66 are used to ensure a center of disks 52 are aligned with first reticule 56.

Disks 52 may include one or more holes which are positioned such that they provide a second reticule which aligns with elements of first reticule 56 of sight 50, and hence assist the operator to more accurately align the two. Preferably, the hole 68 at the center of disk 52 is sized and shaped so as to align with the shape of first reticule 56.

Figure 3:
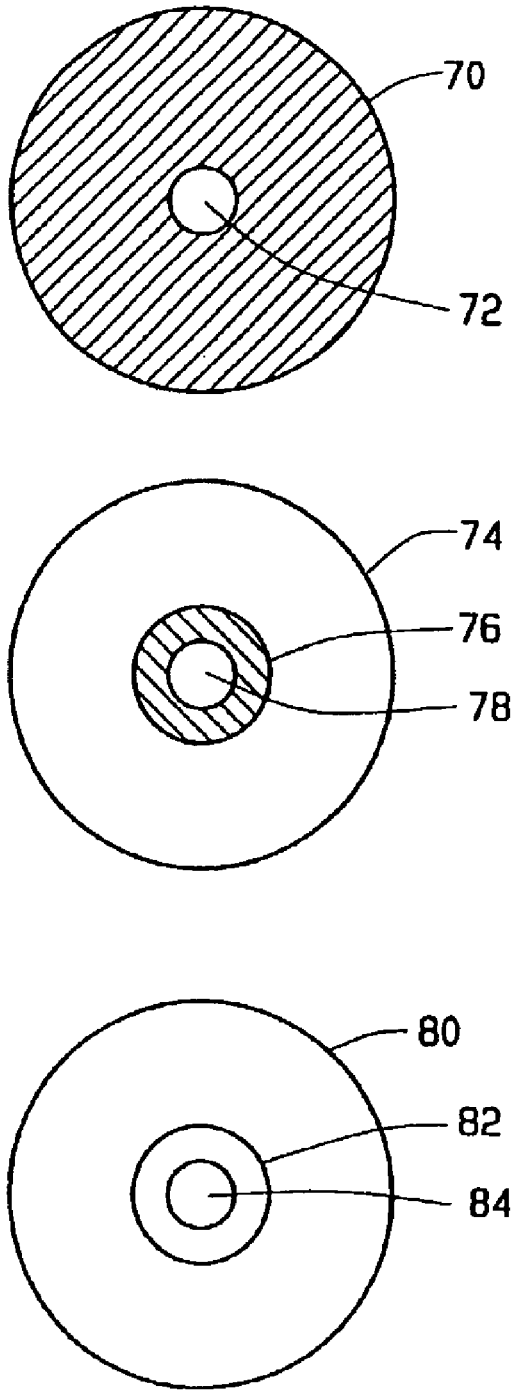
FIG. 3 shows a number of embodiments of transparent disks.

FIG. 3 illustrates a plurality of embodiments for disks 14 (shown in FIG. 1) and 52 (shown in FIG. 2). A colored transparent disk 70 with a single hole 72 is shown. While hole 72 is shown as a circle, it is contemplated that hole 72 could be any geometric form as long as hole 72 is aligned with first reticule 56 (shown in FIG. 2) to act as a second reticule for better alignment of telescopic sight 50 with a target. In another embodiment, a transparent disk 74 incorporates different aspect or colored concentric circle 76 around a hole 78. Also a transparent disk 80 incorporates a transparent concentric circle 82 around hole 84.

Preferably, any of the above described disks mounted in sleeve 12 or in sight 50 are configured such that when using a conventional single reticule optical sight, the concentric circles and/or the hole is superimposed upon the reticule. Furthermore, as a means for aligning the disk with the reticule, a reticule could be provided with a number of concentric circles in addition to the usual cross hairs. Therefore, it is easier for a user to accurately align the superimposed circle and the reticule circles so as to be concentric in comparison to the ability of a user to align the superimposed circle formed by the hole in the colored disk with the cross hairs of the optical sight.

The aiming device may also be used with an electronic sight which uses a liquid crystal display or a cathode ray tube for forming the reticule. In summary, the system described herein is either a back sight which is a simple add on to an existing telescopic sight or a device mechanically incorporated into such a telescopic sight. The device enables the weapon to be aimed in a similar manner to one utilizing iron forward and rear sights (two points of reference), though of course with much greater accuracy.

While the invention has been described in terms of various specific embodiments, those skilled in the art will recognize that the invention can be practiced with modification within the spirit and scope of the claims.

What is claimed is:

1. A telescopic optical sight for aiming a weapon at a target, said telescopic optical sight comprising:

an eyepiece;

a first reticule, provided at a focal point for said eyepiece of said telescopic optical sight;

a second reticule, wherein said second reticule comprises at least one circular, colored, transparent disk having a hole therethrough, said second reticule spaced laterally from said first reticule, said second reticule aligning with said first reticule to aim the weapon; and at least one object lens, said first reticule and said second reticule between said eyepiece and said object lens.

2. The telescopic optical sight according to claim 1 wherein said hole is approximately 1 mm in diameter.

3. The telescopic optical sight according to claim 1 further comprising an adjustment means, said means utilized to ensure alignment of said second reticule with said first reticule.

4. The telescopic optical sight according to claim 1 wherein said circular disk comprises a plurality of optically polarized disks that are arranged such that their relative arrangement with respect to one another affects the transparency through said plurality.

5. The telescopic optical sight according to claim 1 comprising a plurality of said circular disks, each said disk incorporating a different diameter for said hole such that removal of one or more said disks alters a size of the hole presented to a user of said telescopic optical sight.

6. The telescopic optical sight according to claim 1 wherein said circular disk comprises a concentric circle around said hole, said circle having a different color than a remainder of said circular disk.

7. The telescopic optical sight according to claim 1 wherein said circular disk comprises a concentric circle around said hole.

8. The telescopic optical sight according to claim 1 wherein said hole is located at a center of said circular disk.

9. The telescopic optical sight according to claim 1 wherein said first reticule comprises:

cross hairs; and a plurality of concentric circles, said circles for aligning said hole in said disk with said first reticule.

10. A method for aligning a telescopic sight with a target, the telescopic sight having an eyepiece, an object lens, a first reticule provided at a focal point for said eye-piece, and a second reticule, the first reticule and the second reticule being between the eyepiece and the object lens, said method comprising:

aligning a first reticule of the sight with the target; and superimposing the second reticule over the first reticule, the second reticule including a colored, transparent disk with a discontinuity at its center, while the first reticule is in alignment with the target.

11. A method according to claim 10 wherein a mark for the first reticule and a mark for the second reticule are the same mark.

* * * * *